US005437339A

United States Patent [19]

Tanaka

[11] Patent Number: 5,437,339

[45] Date of Patent: Aug. 1, 1995

[54] AIR-PRESSURE-OPERATED IMPLUSION MECHANISM

[75] Inventor: Hiroshi Tanaka, Tokyo, Japan

[73] Assignee: Max Co., Ltd., Tokyo, Japan

[21] Appl. No.: 32,324

[22] Filed: Mar. 17, 1993

[30] Foreign Application Priority Data

Mar. 18, 1992 [JP] Japan ..... 4-091519
Oct. 12, 1992 [JP] Japan ..... 4-077258 U

[51] Int. Cl.[6] ..... B25C 1/04

[52] U.S. Cl. ..... 173/210; 227/130; 92/85 R

[58] Field of Search ..... 173/212, 211, 101, 210; 227/170; 92/85 B, 85 R

[56] References Cited

U.S. PATENT DOCUMENTS 3,060,894 10/1962 Dean, Jr. et al. ..... 173/212 X
3,192,972 7/1965 Tenney ..... 173/101 X
3,710,690 1/1973 Dye ..... 92/85 B
3,788,404 1/1974 Koudel Ka et al. ..... 173/211
4,213,301 7/1980 Maier et al. ..... 227/130 X
4,624,325 11/1986 Steiner ..... 173/212
4,666,074 5/1987 MacDonald ..... 173/211 X
4,871,035 10/1989 Ekwall ..... 173/212
5,048,618 9/1991 Lagne ..... 173/212

FOREIGN PATENT DOCUMENTS 1361944 7/1974 United Kingdom .
2129733 5/1984 United Kingdom .

*Primary Examiner*—Rinaldi I. Rada
*Attorney, Agent, or Firm*—Cushman Darby & Cushman

[57] ABSTRACT

A weight piston according to the present invention, which is slidable along the axis of drive of a drive piston, is moved in the direction opposite to the direction of movement of the drive piston, to cancel the reaction force which is produced by the movement of the latter, thereby to prevent application of the upward reaction force to the housing of the tool. More specifically, the diameter of the weight piston is made larger than that of the drive piston, so that a part of the reaction force produced by the weight piston acts on the housing in the direction of movement of the drive piston.

6 Claims, 8 Drawing Sheets

AIR-PRESSURE-OPERATED IMPLUSION MECHANISM

BACKGROUND OF THE INVENTION

1. Field of the Industrial Application

This invention relates to an air-pressure-operated impulsion mechanism used for a nailing machine or the like, in which an impulsion piston slidably fitted in an impulsion cylinder is driven impulsively by compressed air, so that a nail is hammered with a driver coupled to the impulsion piston.

2. Description of the Prior Art

An air-pressure-operated nailing machine is known in the art in which a piston in a cylinder is driven impulsively by compressed air, so that a fixing metal piece such as a nail is hammered into articles such as walls, plates, etc. The conventional nailing machine has an impulsion mechanism as outlined in the part (a) of FIG. 11. That is, an impulsion cylinder 80 is fixedly mounted in a housing (not shown), and an impulsion piston 81 coupled to a driver 82 is slidably fitted in the impulsion cylinder 80, thus dividing the impulsion cylinder 80 into an upper chamber and a lower chamber. Compressed air is introduced into the impulsion cylinder above the impulsion piston 81; i.e., into the upper chamber, so that the impulsion piston 81 is moved downwardly to cause the driver 82 to hammer the nail into the article.

The compressed air introduced into the upper chamber of the cylinder 80 moves the impulsion piston 81 downwardly in FIG. 11. In response to the movement of the impulsion piston 81, a reaction force is produced which acts on the inner surface of the upper chamber of the substantially closed impulsion cylinder 80 to thereby to move the impulsion cylinder 80 upwardly. This reaction force, while moving the impulsion piston 81 impulsively, moves the housing and a shock-absorbing bumper 83 upwardly which is provided in the impulsion cylinder 80 at the lower end. As a result, the impulsion piston is stopped at a position higher than its original stop position by the bumper 83, which reduces the hammering force of the nailing machine.

In order to minimize the bounce of the nailing machine due to the above-described reaction force, it is necessary for the operator to strongly push the nailing machine against the article. Therefore, it is excessively laborious for the operator to use the nailing machine for a vertical wall or a ceiling or to handle it while standing on the unstable scaffold. Furthermore, the force of pushing the nailing machine against the article is liable to fluctuate, and therefore the amount of bounce of the nailing machine is variable, and the hammering force of the latter is also variable.

In order to eliminate the above-described difficulties due to the reaction force, a non-reaction type nailing machine whose hammering force is stable has been proposed in the art for instance by Japanese Utility Patent Application (OPI) No. 29272/1991 (the term "OPI" as used herein means an "unexamined published application"). The nailing machine is as outlined in the part (b) of FIG. 11. The impulsion mechanism of the nailing machine is designed as follows: An impulsion piston 91 is slidably fitted in an impulsion cylinder 90, which is slidably fitted in a housing 94. A piston stopping bumper 93 is arranged in the housing 94. Compressed air introduced into the impulsion cylinder moves the impulsion piston 91 downwardly, and in response to the downward movement of the impulsion piston a reaction force is produced to move the impulsion cylinder 90 upwardly of the housing 94; that is, the reaction force thus produced, acting on the impulsion cylinder 90, is not transmitted to the housing 94.

Hence, the position of the piston stopping bumper 93 is not changed with respect to the article; that is, the impulsion piston stop position is constant at all times, and accordingly the hammering force is consistently maintained. On the other hand, an energizing force, which is provided by the compressed air and by a compression spring 95 for returning the movable impulsion cylinder 90 to the initial bottom dead center, is formed between the impulsion cylinder 90 and the housing 94. Therefore, the movement of the movable impulsion cylinder 90 due to the reaction is transmitted to the housing 94 through the above-described energizing means such as the compression spring 95. Thus, the housing 94 is not completely free from the reaction. In order to eliminate this difficulty, another technique has been proposed in the art. In the technique, the above-described impulsion mechanism is improved as follows: The impulsion cylinder is energized downwardly by using air pressure, and in synchronization with the driving of the impulsion piston, the energizing compressed air is discharged into the outside air, so that the housing is completely free from the reaction. However, the technique is still disadvantageous in that the impulsion mechanism is intricate in arrangement and accordingly the nailing machine is high in manufacturing cost.

On the other hand, an impulsion tool such as a nailing machine is used under various work conditions. For instance in the case where a cover material is nailed to a backing material with a nailing machine, the cover material may be deformed, thus forming a space between the two materials. In this case, it is essential to hold the two materials in close contact with each other by pushing the nailing machine against the surface of the cover material. Even in a nailing operation with the above-described conventional non-reaction type nailing machine, it is necessary to push the nailing machine against the article. When, in order to perform a nailing operation, the operator must stand on the unstable scaffold, the nailing operation is laborious and dangerous.

SUMMARY OF THE INVENTION

Accordingly, a problem to be solved by the invention is to provide an impulsion mechanism applicable to an air-pressure operated nailing machine or the like in which the housing is positively prevented from being moved away from the surface of the article by the reaction produced when the impulsion piston is moved, and an action force is produced to move the housing towards the article in synchronization with the driving of the nailing machine.

In order to solve the above-described problem, a first aspect of the present invention provides a compressed-air-operated impulsion mechanism which comprises: an impulsion cylinder fixedly arranged in the housing of a tool; an impulsion piston slidably fitted in the impulsion cylinder, the impulsion piston being driven by leading compressed air to the upper end face of the impulsion piston in the impulsion cylinder; and a reaction absorbing member which is provided in the impulsion cylinder above the impulsion piston, and which has a downwardly faced effective area which is larger than the upwardly faced effective area of the impulsion piston, and is confronted with the upper surface of the impulsion piston, the reaction absorbing member being slidable along the operating axis of the impulsion piston.

In order to solve the above-described problem, a second aspect of the present invention provides a compressed-air-operated impulsion mechanism, in which, an impulsion cylinder which is fixedly arranged in the housing of a tool and in which an impulsion piston is slidably fitted is provided, a sub-cylinder larger in inside diameter than the impulsion cylinder is formed on the upper end of the impulsion cylinder in such a manner that the sub-cylinder is coaxial with the impulsion cylinder, thus providing a cylinder assembly, a weight piston larger in outside diameter than the impulsion piston is slidably fitted in the sub-cylinder, and the wall of the cylinder assembly has an air supply hole to lead compressed air into the cylinder assembly between the impulsion piston and the weight piston.

In order to solve the above-described problem, a third aspect of the present invention provides a compressed-air-operated impulsion mechanism, in which, an impulsion cylinder open at the upper end in which an impulsion piston is slidably fitted is fixedly mounted in a housing, a movable sleeve larger in inside diameter than the impulsion cylinder is provided around the impulsion cylinder in such a manner that the movable sleeve is axially slidable, the upper end of the movable sleeve is closed, to form a compressed-air acting surface on the inner surface of the movable sleeve, the compressed-air acting surface being faced downwardly and larger than the sectional area of the impulsion piston, and an air supply hole is formed in the side wall of the movable sleeve to lead compressed air to the upper end face of the impulsion piston in the impulsion cylinder and into the movable sleeve.

In driving the impulsion piston with a compressed air pressure, the reaction absorbing member whose effective area is larger than the sectional area of the impulsion piston, is driven in the opposite direction by using that compressed air pressure. Therefore, all the reaction force which is induced when the impulsion piston is driven, is absorbed by part of the reaction force which is produced when the reaction absorbing member is driven in the opposite direction; that is, production of the reaction force attributed to the driving of the impulsion piston can be eliminated completely. On the other hand, the remaining of the reaction force produced when the reaction absorbing member is driven, is applied to the housing, so that the housing is moved downwardly in synchronization with the driving of the impulsion piston.

In the case where the above-described impulsion mechanism is applied to a nailing machine, no reaction force is produced which raises the nailing machine body upwardly, and therefore the impulsion piston is stopped at a predetermined position at all times. Hence, with the nailing machine, the nail can be hammered stably. In addition, by increasing the difference in diameter between the impulsion piston and the reaction absorbing member so that a downward force acts on the housing, it can be made unnecessary to strongly push the nailing machine against the article such as a wall or plate in the nailing operation.

Further, the weight piston, according to the invention, may be at least partially made of a metal material high in specific gravity. The weight piston may comprise: a hollow piston body made of iron, aluminum or the like; and a core member made of a metal material high in specific gravity, which is inserted in the piston body.

Furthermore, the weight piston may be designed as follows: The weight piston is axially divided into a plurality of parts, and at least one of the plurality of parts is made of a metal material high in specific gravity.

When the drive piston is driven by compressed air, the compressed air drives the weight piston in the direction opposite to the direction of movement of the drive piston, so that the reaction force is absorbed which is produced in response to the movement of the drive piston, and accordingly it is not applied to the housing at all. Furthermore, the weight piston is made of the metal material high in specific gravity. Hence, the weight per volume of the weight piston can be increased, and therefore the stroke covered by the weight piston during the operation of the drive piston can be decreased. In addition, for the same reason, the height of the weight piston can be decreased with the outside diameter maintained unchanged.

In the impulsion mechanism, the weight piston can be decreased in height and in stroke. Therefore, an nailing machine or the like employing the impulsion mechanism can be decreased in height; that is, a tool like a nailing machine or the like can be decreased in size and in weight.

Figure 11A:
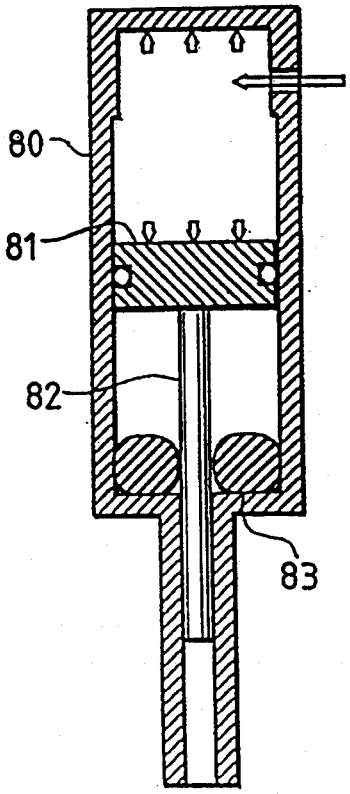
FIG. 11(a) PRIOR ART
Figure 11B:
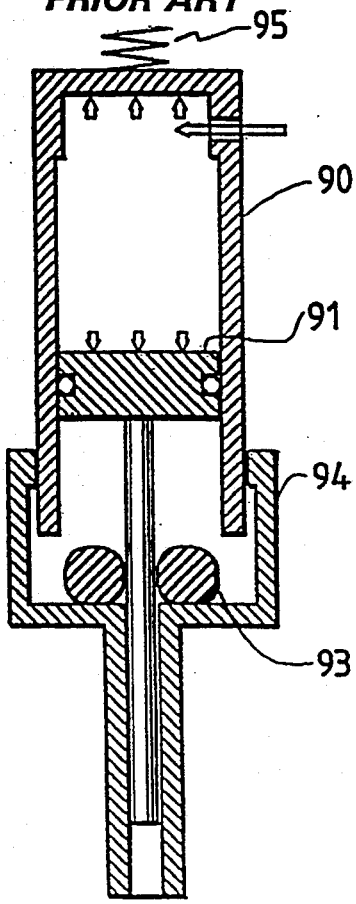
FIG. 11(b) PRIOR ART

The parts (*a*) and (*b*) of FIG. 11 are explanatory diagrams for a description of the production of reactions by conventional impulsion mechanisms.

DETAILED DESCRIPTION OF THE EMBODIMENTS

Figure 1:
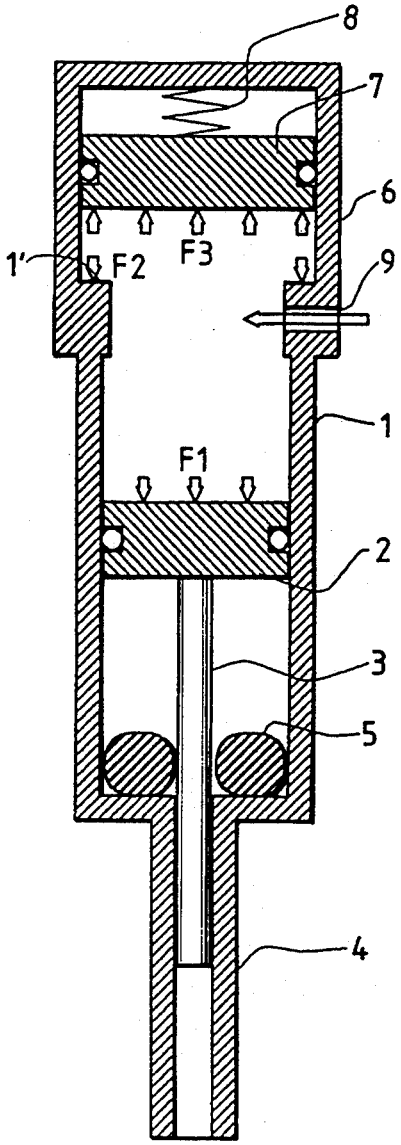
FIG. 1 is an explanatory diagram for a description of the fundamental principle of a reaction absorbing operation of an impulsion mechanism according to the present invention.

FIG. 1 outlines the arrangement of an example of an impulsion mechanism in a nailing machine according to this invention.

As shown in FIG. 1, an impulsion piston 2 coupled to a driver 3 which is extended downwardly is slidably fitted in an impulsion cylinder 1, which is fixedly secured to a housing. A cylindrical nose member 4 for slidably guiding the driver 3 is provided below the housing. A bumper 5, which is adapted to absorb the impulsion force of the impulsion piston 2 thereby to stop the latter 2, is provided on the upper end face of the nose member 4. The upper end of the impulsion cylinder 1 merges with the lower end of a sub-cylinder 6 the inside diameter of which is larger than the impulsion cylinder 1, thus forming a cylinder assembly. A reaction absorbing member, namely, a weight piston 7, the outside diameter of which is larger than that of the impulsion piston 2, is slidably fitted in the sub-cylinder 6. A compression spring 8 is interposed between the upper end face of the weight piston 7 and the lower surface of the upper wall of the housing, thus urging the weight piston 7 towards the bottom dead center at all times. On the other hand, the impulsion piston 2 is normally set at the top dead center by a piston returning device (not shown).

The cylinder assembly has an air supply inlet 9 between the standby position of the impulsion piston 2 and the bottom dead center of the weight piston 7; more specifically, the air supply inlet 9 is formed in the junction of the two cylinders 1 and 6, so that compressed air is supplied into the cylinder assembly with the aid of a main valve mechanism (not shown). The compressed air supplied into the cylinder assembly drives the impulsion piston 2 downwardly so that the driver 3 coupled to the lower end of the impulsion piston 2 drives a nail from the nose member 3 into a predetermined article such as a wall or a wooden plate. At the same time, the compressed air moves the weight piston 7 upwardly in the sub-cylinder 6.

In the impulsion cylinder 1, the compressed air applies a downward drive force F1 corresponding to the effective diameter of the impulsion piston 2 to the latter 2. Furthermore, the compressed air applies a downward action force F2 to the shoulder 1' of the cylinder assembly which corresponds to the difference in diameter between the impulsion cylinder 1 and the sub-cylinder 6, so as to drive the impulsion cylinder downwardly. In addition, the compressed air applies an upward drive force F3 corresponding to the effective diameter of the weight piston 7; that is, the weight piston 7 is moved upwardly by the upward drive force F3. The sum of the effective areas of the impulsion piston 2 and the shoulder 1' is equal to the effective area of the weight piston 7, and therefore the sum of F1 and F2 is equal to F3. When those members are driven by the forces F1, F2 and F3, reaction forces equal in magnitude to and opposite in direction to those forces F1, F2 and F3 are produced. In this case, the sum of the upward reaction forces corresponding to F1 and F2 is canceled out by the downward reaction force corresponding to F3, so that no upward reaction force acting on the impulsion cylinder 1 or the housing is formed. On the other hand, the housing is moved downwardly through the impulsion cylinder 1 by the drive force F2 which drives the impulsion cylinder 1 downwardly when the compressed air acts on the shoulder 1' of the impulsion cylinder 1.

The weight piston 7 is kept urged towards the bottom dead center by the compression spring 8. Therefore, as the weight piston 7 is moved upwardly, a reaction force is produced to move the housing upwardly. However, the reaction force can be completely eliminated by canceling the force which is applied to the shoulder 1' (corresponding to the difference in diameter between the cylinders 1 and 6 (hereinafter referred to as "a diameter difference", when applicable)) by the compressed air to drive the impulsion cylinder 1 downwardly and the upward drive force applied thereto through the compression spring 8 with each other. In addition, by increasing the aforementioned diameter difference thereby to increase the force of driving the impulsion cylinder downwardly, the housing can be pushed against the article in synchronization with the nailing operation.

In the case where the weight piston 7 is made of a material such as iron so that it is large enough in weight with respect to the impulsion piston 14 having the driver 16, the compression spring 8 can be eliminated.

Figure 3:
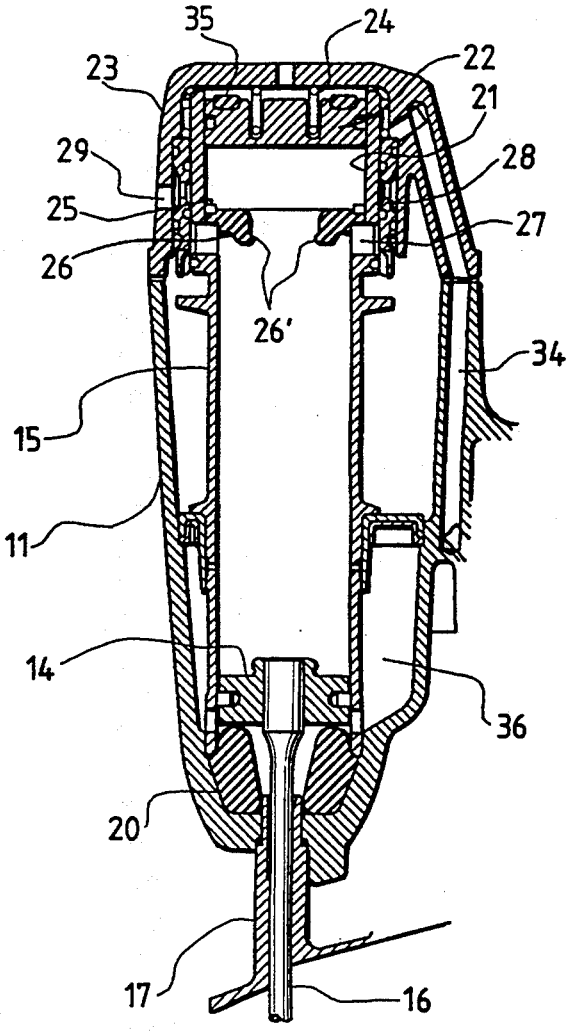
FIG. 3 is a vertical sectional view of essential components of the nailing machine shown in FIG. 2, for a description of an operating state of the latter.
Figure 2:
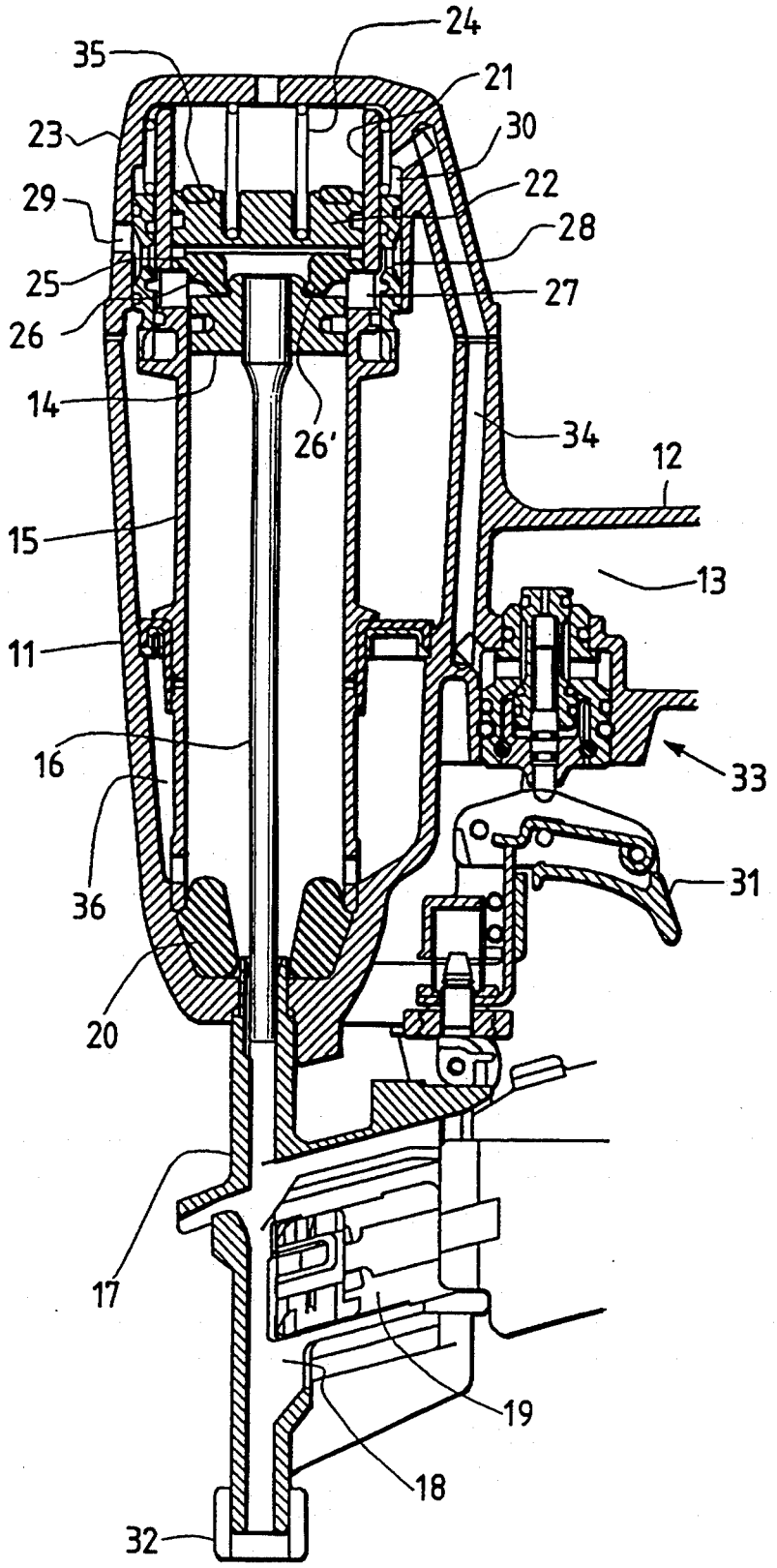
FIG. 2 is a vertical sectional view showing one example of a nailing machine to which a first example of the impulsion mechanism according to the invention is applied.

One example of the nailing machine employing the impulsion mechanism according to the invention will be described with reference to FIGS. 2 and 3. As shown in FIG. 2, an impulsion cylinder 15 is fixedly provided in a housing 11 which forms an outer shell of the nailing machine and has a main chamber 13 for storing compressed air in a grip 12. An impulsion piston 14 coupled to a driver 16, which is extended downwardly, is slidably fitted in the impulsion cylinder 15. A cylindrical nose member 17 is fixedly coupled to the lower end of the housing 11. The nose member 17 is to slidably guide the driver 16 connected to the impulsion piston 14. An opening 18 is formed in a part of the nose member 17, to supply a nail into the nose member 17. More specifically, a nail supplying mechanism 19 is provided to supply a series of nails successively from a magazine (not shown) into the nose member 17. A bumper 20 is provided on the bottom of the housing 11 supporting the lower end of the impulsion cylinder 15, to absorb the impulsion of the impulsion piston 14 to stop the latter.

A sub-cylinder 21, which is larger in inside diameter than the impulsion cylinder 15, is coaxially mounted on the impulsion cylinder 15 in such a manner that the sub-cylinder 21 is integral with the impulsion cylinder 15, thus forming a cylinder assembly. A weight piston 22 is slidably fitted in the sub-cylinder 21. The weight piston 22 is urged towards the bottom dead center by a compression spring 21 at all times which spring is interposed between the weight piston 22 and a cylinder cap 23 closing the upper end of the housing 11. At the junction of the cylinders 15 and 21, a shoulder 25 corresponding to the difference in diameter between the two cylinders is formed. A piston stop 26 is secured to the shoulder 25, to stop the weight piston 22 at the bottom dead center, and the impulsion piston 14 at the top dead center. A piston holder 26' is formed on the lower surface of the piston stop 26, which is engaged with a protrusion formed on the upper surface of the impulsion piston 14 to hold the latter at the top dead center.

An air supply hole 27 is formed in the wall of the cylinder assembly between the impulsion cylinder 15 and the sub-cylinder. The air supply hole 27 is used to introduce compressed air into the cylinder assembly, and to discharge it therefrom. The air supply hole 27 is connected selectively to the main chamber 13 or a air discharge hole 29 by means of a main valve 28, which is arranged in the annular space between the outer cylindrical surface of the sub-cylinder 21 and the inner surface of the cylinder cap 23. The operation of the main valve 28 is controlled by the pressure of the compressed air in a control chamber 30, in which the upper end portion of the main valve 28 is protruded. The control chamber 30 is communicated through an air passageway 34 to a trigger valve 33, which is controlled with a trigger lever 31 which is operated manually, and with a safety unit 32 mounted on the end portion of the nose member 17.

The weight piston 22 is made of a material such as iron so that it is large enough in weight with respect to the impulsion piston 14 having the driver 16. In addition, in order to prevent the impulsion piston 14 from colliding with the inner surface of the cylinder cap 23 before it is stopped striking the bumper 20, the impulsion piston 14 is so designed that it may not move a large stroke. An elastic member 35 is provided on the upper surface of the weight piston 22 so that, when the weight piston strikes the inner surface of the cylinder cap 23, the elastic member absorbs the shock, and reduces the noise.

The operation of the nailing machine thus constructed will be described.

Normally, or when the nailing machine is not in operation, as shown in FIG. 2 the impulsion piston 14 is held at the top dead center in the impulsion cylinder 15 by the piston stop 26, while the weight piston 22 is positioned at the bottom dead center by the elastic force of the compression spring 24 while abutting against the upper surface of the piston stop 26. On the other hand, the main valve 28 is positioned at the bottom dead center by the compressed air which is supplied into the control chamber 30 through the trigger valve 33. Therefore, in the cylinder assembly, the space between the two pistons 14 and 22 is communicated through the air discharge hole 29 with the outside air, so that the atmospheric pressure exists therein.

When the trigger lever 31 is manually operated with the safety unit operated; that is, when the trigger valve 33 is activated, the compressed air in the control chamber 30 of the main valve 28 is discharged into the outside air through the air passageway 34, as a result of which the main valve 28 is moved upwardly by the compressed air in the main chamber 23 which acts on the lower end of the main valve 28. As the main valve 28 is moved upwardly in this manner, the air supply hole 27 is disconnected from the air discharge hole 29 and connected to the main chamber 13, so that the compressed air in the main chamber 13 is introduced into the cylinder. The impulsion piston 14 and the weight piston 22 are impulsively moved in the opposite directions by the compressed air thus introduced.

When the impulsion piston 14 is moved downwardly in the impulsion cylinder 15, the driver 16 integral with the impulsion piston 14 hammers the nail, which has been supplied into the nose member 17. Thus, the nail is driven into the article set at the lower end of the nose member 17. On the other hand, the weight piston 22 is moved upwardly against the elastic force of the compression spring 24. The reaction force induced when the impulsion piston 14 is driven is all absorbed by the movement of the weight piston 22 which is larger in diameter than the impulsion piston 14; that is, no reaction force moving the housing 11 upwardly is produced at all. Part of the reaction force produced by the upward movement of the weight piston 22 larger in diameter than the impulsion piston 14 is canceled by the reaction force of the impulsion piston 14. However, the reaction force attributing to the difference in diameter between the two pistons 14 and 22 is applied to the shoulder 25 downwardly which is formed at the junction of the impulsion cylinder 15 and the sub-cylinder 21. This reaction force is transmitted through the impulsion cylinder 15 to the housing 11, to move the latter 11 downwardly.

As the weight piston 22 is moved upwardly in the above-described manner, an upward force is applied to the cylinder cap 23 and accordingly to the housing 11 through the compression spring 24 interposed between the weight piston 22 and the cylinder cap 23. However, the upward movement of the housing 11 due to the reaction can be completely eliminated by determining the above-described diameter difference so that the force applied through the compression spring 24 is equal to the downward force produced by the shoulder 25 at the junction of the cylinders. On the other hand, the diameter difference may be increased; that is, the downward reaction force attributing to the diameter difference may be increased, thereby to positively produce a downward reaction force to the housing 11.

When, after the nailing operation, the trigger lever 31 and the safety unit 32 are released; that is, when the trigger lever 32 is placed in the initial state, compressed air is supplied into the control chamber 30 of the main valve 28 again, so that the latter 28 is returned to the lower position. Thereupon, the two cylinders 15 and 21 are communicated through the air discharge hole 29 to the outside air, so that the compressed air is discharged from the cylinders. On the other hand, the compressed air in a return chamber 36 formed around the impulsion cylinder acts on the lower surface, to move the impulsion piston 14 upwardly to the top dead center, so that the latter 14 is stopped being locked to the locking portion 26' of the piston stop 26. On the other hand, the weight piston 22 is returned by the elastic force of the compression spring 24 to the bottom dead center, where it abuts against the upper surface of the piston stop 26.

Figure 4:
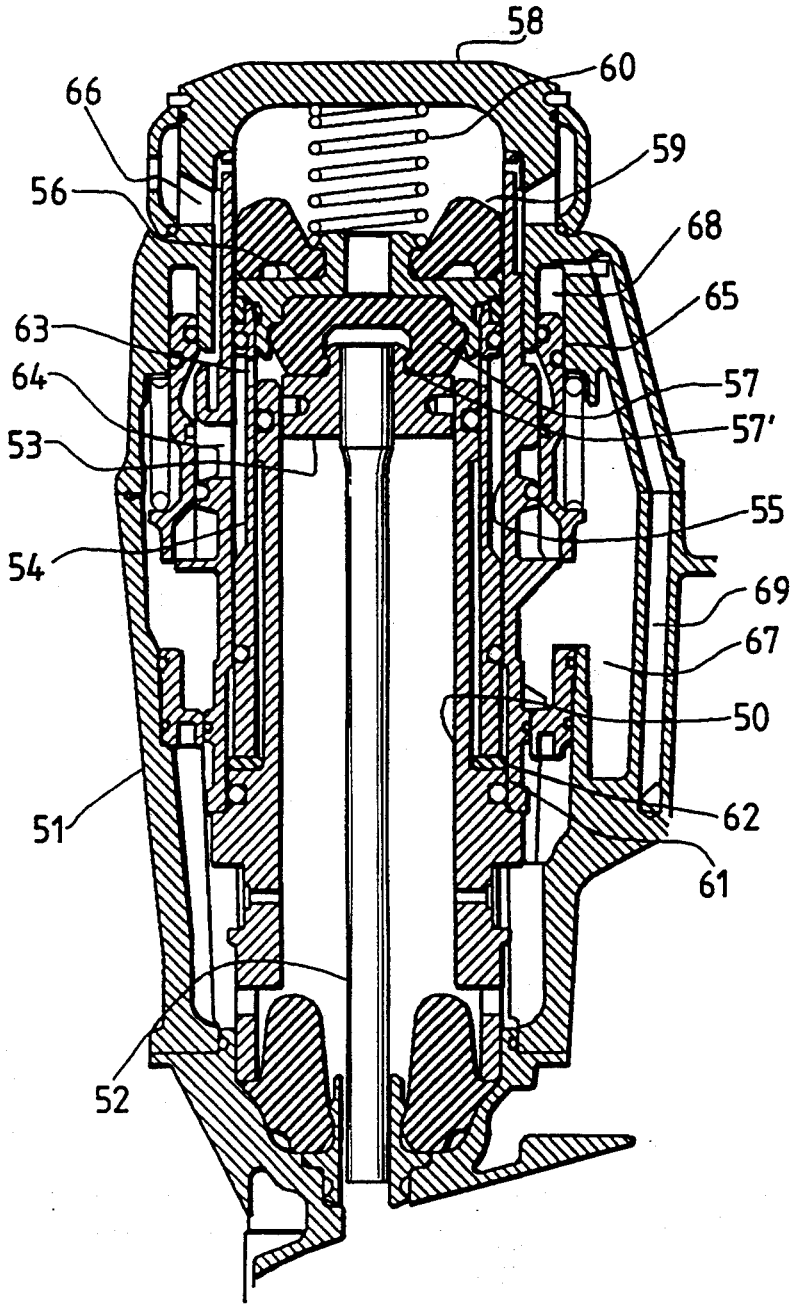
FIG. 4 is a vertical sectional view of essential components of a nailing machine to which another example of the impulsion mechanism according to the invention is applied.
Figure 5:
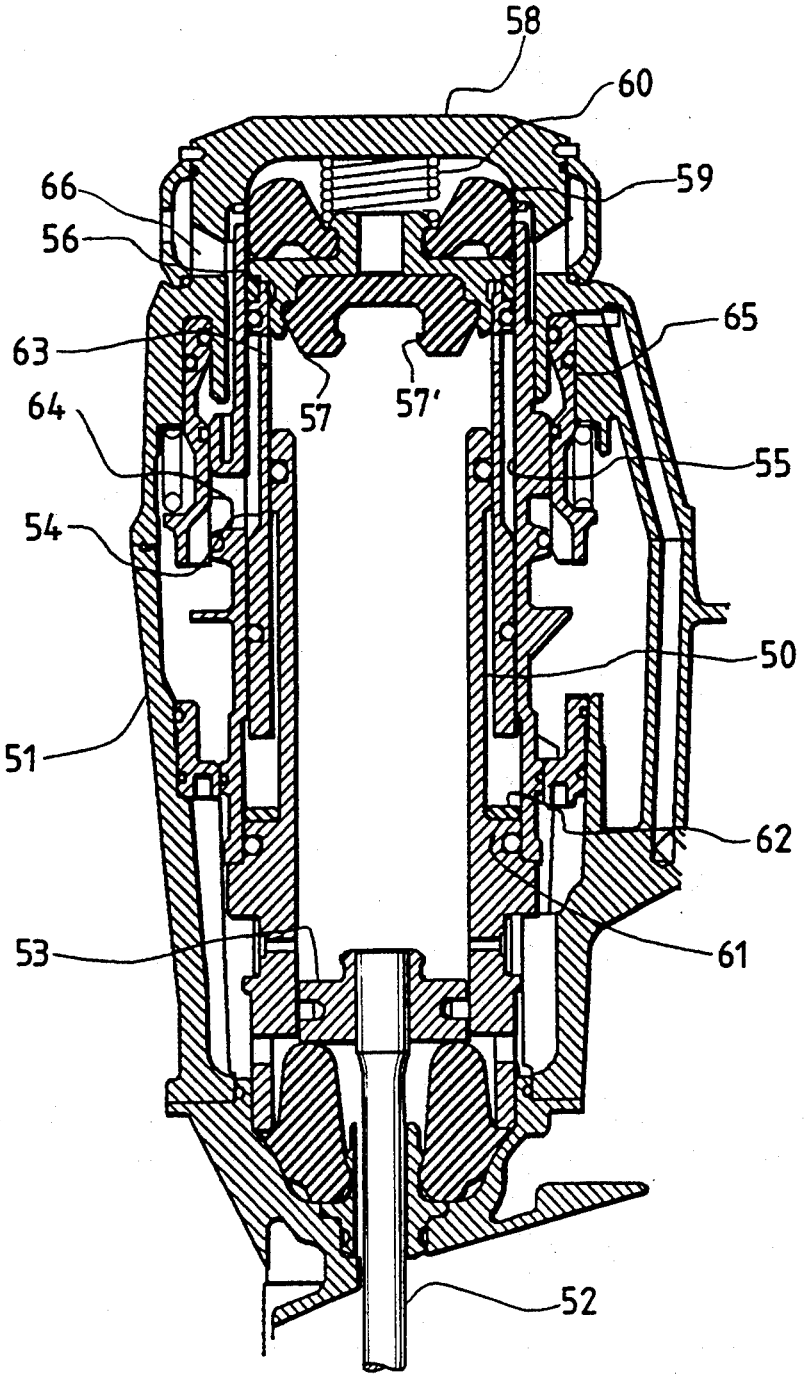
FIG. 5 is a vertical sectional view of essential components of the nailing machine shown in FIG. 4, for a description of an operating state of the latter.

Another embodiment of the invention will be described with reference to FIGS. 4 and 5. In this embodiment, an impulsion cylinder 50, the upper end of which is open, is fixedly arranged in a housing 51. An impulsion piston 53 with a driver 52, which is extended downwardly, is slidably fitted in the impulsion cylinder 50. A movable sleeve 54 is provided around the impulsion cylinder 50. Being guided by the outer cylindrical surface of the impulsion cylinder 50 and by the inner cylindrical surface of a guide sleeve 55 which surrounds the movable sleeve 54 and is fixedly secured to the housing 51, the movable sleeve 54 is slidable axially of the impulsion cylinder 50.

The inside diameter of the movable sleeve 54 is larger than that of the impulsion cylinder 50 as much as the wall thickness of the latter 50. The top of .the movable sleeve 54 is closed with a sleeve cap 56. The space in the movable sleeve 54 and the space in the impulsion cylinder 50 above the impulsion piston 53 form a common cylinder space. A piston stop 57 with a holder 57' is provided under the sleeve cap 56. The piston stop 57 is to absorb the shock caused by the impulsion piston 53 and to lock a protrusion formed on the upper end face of the impulsion piston 53 to hold the latter 53 at the top dead center. A shock absorbing member 59 is provided on the upper surface of the sleeve cap 56, to absorb the shock produced when the movable sleeve 54 strikes against a cylinder cap 58. A compression spring 60 is interposed between the sleeve cap 56 and the inner surface of the cylinder cap 58, to urge the movable sleeve 54 downwardly at all times. A step 61 is formed on the outer cylindrical surface of the impulsion cylinder 50 so as to support the lower end of the movable sleeve 54 at its bottom dead center. A cushion 62 is provided on the step 61, to absorb the shock produced when the movable sleeve 54 strikes against the impulsion cylinder 50.

An air supply hole 63 is formed in the upper portion of the cylindrical wall of the movable sleeve 54, while a through-hole 64 is formed in the cylindrical wall of the guide sleeve 55, so that the above-described common cylinder space is communicated selectively with an air discharge hole 66 or a main chamber 67 with the aid of a main valve 65 which is provided outside the guide sleeve 55. The main valve 65 is arranged in an annular space which is defined by the outer cylindrical surface of the guide sleeve 55 and the inner cylindrical surface of the cylinder cap 58. With the upper end portion of the main valve 65 in a control chamber 68, the main valve 65 is operated by the compressed air which is supplied to or discharged from the control chamber 68 through a passageway 69.

Normally, or when the nailing machine is not in operation, the movable sleeve 54 is held at the bottom dead center by the compression spring 60, and the impulsion piston 53 is held at the top dead center being held by the holder 57' of the piston stop 57 coupled to the movable sleeve 54. When the main valve 65 is moved upwardly by the operation of the trigger valve (not shown), compressed air is introduced into the above-described common cylinder space. The compressed air thus introduced moves the impulsion piston 53 and the movable sleeve 54 in the opposite directions. As a result, the impulsion piston 53 hammers the nail through the driver 52, while the compressed air acts on the surface of the movable sleeve 54 which is larger than that of the impulsion piston 53, so that the movable sleeve 54 is moved upwardly against the elastic force of the compression spring 60.

The upward reaction force which is induced when the impulsion piston 53 is driven, is canceled by a part of the downward reaction force which is produced when the movable sleeve 54 is driven, and the remaining of the downward reaction force acts on the part of the impulsion cylinder, which corresponds to the difference in diameter between the impulsion cylinder 50 and the movable sleeve 54, to move the impulsion cylinder 50 downwardly thereby to move the housing downwardly. By setting the difference in inside diameter between the impulsion cylinder 50 and the movable sleeve 54 so that the above-described downward reaction force (applied to the part of the impulsion cylinder which corresponds to the difference in diameter between the impulsion cylinder and the movable sleeve 54) is equal to or larger than the upward force which is transmitted through the compression spring 60 to the housing when the movable sleeve 54 is moved upwardly, the following effect is obtained. That is, when the impulsion piston 53 is driven, production of the reaction force can be eliminated completely, or the housing 11 can be positively moved towards the article.

Figure 6A:
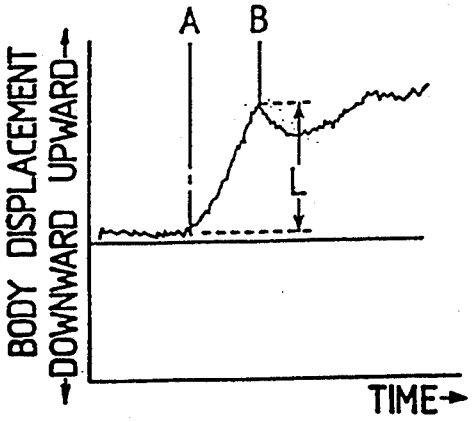
FIG. 6(a) PRIOR ART
FIG. 6 indicates the results of measurement on displacement of a housing of an impulsion mechanism in a nailing machine. More specifically, the part (*a*) of FIG. 6 is a graphical representation indicating the results of measurements given to the impulsion mechanism of the conventional nailing machine, and the part (*b*) of FIG. 6 is also a graphical representation indicating the results of measurements given to the impulsion mechanism according to the invention.
Figure 6B:
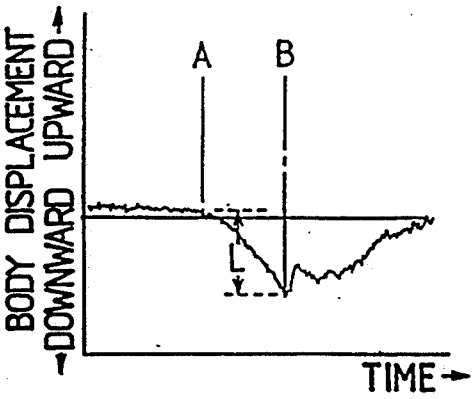

The parts (*a*) and (*b*) of FIG. 6 are graphical representations indicating experimental data of the nailing machine of the invention and the conventional nailing machine, which are measured with forces applied to the housing as displacements of the housing. In each of those graphical representations, the horizontal axis represents time, and the vertical axis represents displacements of the housing in a upward or downward direction. More specifically, the part (*a*) of FIG. 6 indicates the results of measurement given to the conventional nailing machine shown in the part (*a*) of FIG. 11. As is apparent from the part (*a*) of FIG. 6, with the conventional nailing machine, upward displacement of the housing is started at the time instant (A) immediately after the main valve is operated to introduce the compressed air into the cylinder, and the housing is raised as much as L1 from the article such as a wall or plate at the time instant (B). On the other hand, the part (*b*) of FIG. 6 indicates displacements L2 of the housing of the nailing machine according to the invention in which the difference in diameter between the impulsion cylinder and the movable sleeve is so determined that the reaction force acting on it is larger than the reaction force applied through compression spring. In the part (*b*) of FIG. 6, in contrast to the part (*a*) of FIG. 6 concerning the conventional nailing machine, downward displacement of the housing is started at the time instant (A).

Figure 7:
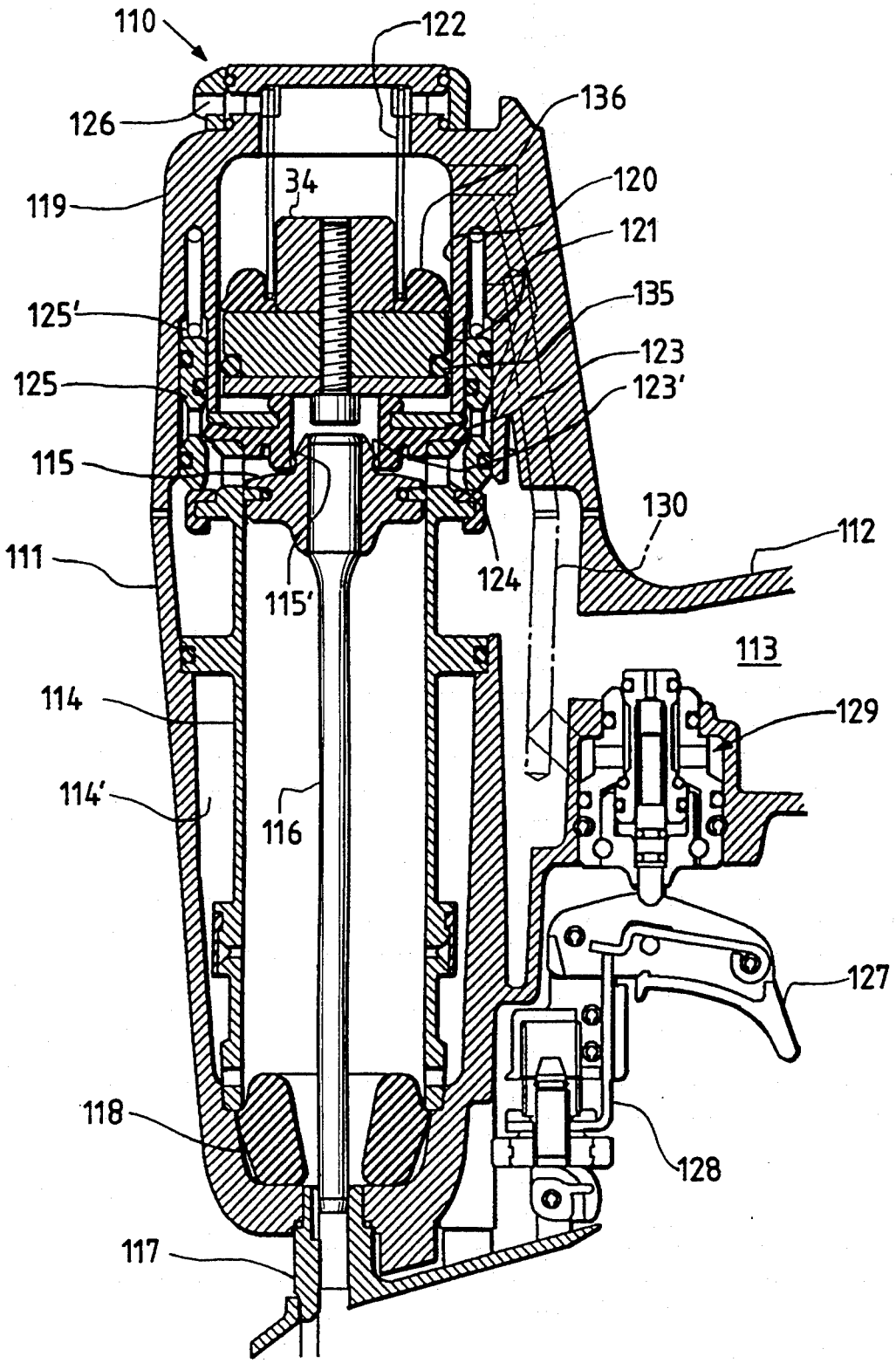
FIG. 7 is a vertical sectional side view showing a nailing machine to which further example of an impulsion mechanism according to this invention is applied.

FIG. 7 shows a nailing machine to which further example of an impulsion mechanism according to this invention is applied.

The nailing machine, as shown in FIG. 7, has a housing 111, which is the outer shell of the nailing machine, and forms a main chamber 113 for storing compress air in a grip 112. A drive cylinder 114 is fixedly mounted in the housing 111. A drive piston 115 coupled to a driver 116, which is extended downwardly, is slidably fitted in the driver cylinder 114. A cylindrical nose member 117 is fixedly secured to the lower end of the housing 111, to slidably guide the driver 116 coupled to the drive piston 115. A series of nails are supplied into the nose member 117 one at a time. A bumper 118 is arranged on the bottom of the housing 111 which supports the drive cylinder 114 at the lower end. The bumper 118 is to absorb the shock which is caused when the drive piston is driven.

A cylinder cap 119 is mounted on the housing 111 in such a manner that it closes the upper opening of the housing 111. A sub-cylinder 120 larger in inside diameter than the drive cylinder 114 is formed inside the cylinder cap 119 in such a manner that the sub-cylinder 120 is coaxial with the drive cylinder 114. A weight piston 121 is slidably fitted in the sub-cylinder 120. The weight piston 121 is urged towards the bottom dead center by a compression spring 122 at all times, which is interposed between the upper wall of the cylinder cap 119 and the weight piston 121. A piston stop 123 is interposed between the upper end face of the drive cylinder 114 and the lower end face of the sub-cylinder 120, to stop the drive piston 115 at the top dead center and the weight piston 121 at the bottom dead center. A piston holder 123 is formed in the lower portion of the piston stop 123. The piston holder 123 is engaged with a protrusion 115' formed on the upper end face of the drive piston 115, to hold the latter 115 at the top dead center.

An air supply hole 124 is formed in the upper portion of the side wall of the drive cylinder 114, to lead compressed air into the drive cylinder 114 and to discharge the compressed air from the drive cylinder 114. The air supply hole 114 is connected selectively to the main chamber 113 and an air discharge hole 126 by means of an annular main valve 125, which is arranged in an annular space formed between the outer cylindrical surface of the sub-cylinder 120 and the inner cylindrical surface of the cylinder cap 119. The main valve 125 is operated by the pressure of the compressed air in a control chamber 125' in which the upper end portion of the main valve 125 is inserted. The control chamber 125' is communicated through an air passageway 130 with a trigger valve 129. The latter 129 is operated by a trigger lever 127 which is manually operated, and by a safety mechanism 128 a part of which is extended to the end of the above-described nose member 117.

Figure 8:
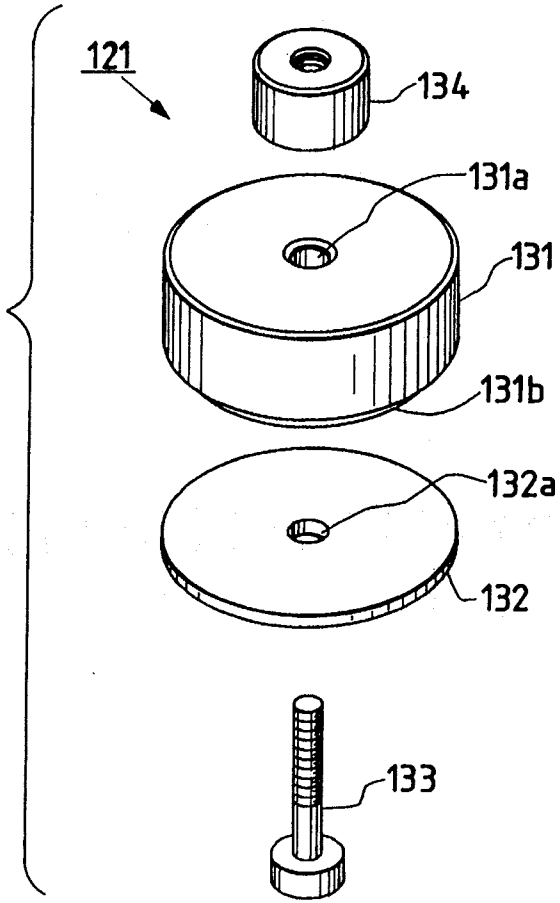
FIG. 8 is an exploded perspective view showing the structure of a weight piston in the impulsion mechanism.

The weight piston 121 of the further example of the present invention, as shown in FIG. 8, comprises: a core member 131 which is made of a heavy metal material such as lead or tungsten; and a bottom plate 132 which is made of a metal material such as aluminum. The core member 131 is substantially in the form of a cylinder with a through-hole 131*a* at the center, and it has a step 13*b* along the peripheral edge of the lower end face. The bottom plate 132 is in the form of a disk which has a through-hole 132*a* at the center and is substantially equal in outside diameter to the core member 131.

A cylindrical spring guide 134 having a female-threaded hole at the center is placed on the core member 131, and a bolt 133 is inserted into the through-hole 132*a* of the bottom plate 132 and the through-hole 131*a* of the core member 131 in the stated order, and is threadably engaged with the spring guide 134. Thus, the weight piston has been formed. A slide-sealing O-ring 135 is fitted in an annular groove which is formed between the step 131*b* of the core member 131 and the upper surface of the bottom plate 132. The weight piston with the O-ring 135 is fitted in the sub-cylinder 120. In order to absorb the shock and noise produced when the weight piston strikes against the inner surface of the upper wall of the cylinder cap 119, an elastic member 136 is placed on the upper surface of the weight piston 121, as seen in FIG. 7.

The operation of the nailing machine thus organized will be described.

Normally, or when the nailing machine is not in operation, as shown in FIG. 7 the drive piston is held at the top dead center in the drive cylinder with its protrusion 115' engaged with the piston holder 123', while the weight piston 121 is held at the bottom dead center while being abutted against the upper end face of the piston stop 123 by the compression spring 122. The inside of the drive cylinder 114 between the drive piston 115 and the weight piston 121 is communicated with the air discharge hole 126; that is, it is under the atmospheric pressure, because the main valve 125 is positioned at the bottom dead center by the compressed air which is supplied into the control chamber 125' by means of the trigger valve 129.

When, with the nailing machine pushed against an article such as a wall or plate, the safety mechanism 128 is operated and the trigger lever 127 is manually operated to activate the trigger valve 129, the compressed air in the control chamber 125' of the main valve 125 is discharged through the air passageway 130 into the outside air. As a result, the pressure of the compressed air in the main chamber 113, acting on the lower end of the main valve 125, moves the latter 125 upwardly. As the main valve 125 is moved upwardly in this manner, the air supply hole 124 is disconnected from the air discharge hole 126 and connected to the main chamber 113, so that the compressed air in the main chamber 113 is led into the drive cylinder 114. The compressed air thus led acts on the upper end face of the drive piston 115 to move the latter 115 downwardly. The compressed air is further led into the sub-cylinder 120 through an opening formed in the piston stop 123 at the center, thus acting on the lower end face of the weight piston 121 to move the latter 121 upwardly.

When the drive piston 115 is driven downwardly in the drive cylinder, the driver 116 integral with the drive piston 115 hammers the nail, which has been supplied into the nose member 117, into the article set under the lower end of the nose member 117. On the other hand, the weight piston 121 is moved upwardly against the elastic force of the compression spring 122. The reaction force produced when the drive piston 115 is driven, is all absorbed by the upward movement of the weight piston 121 which is larger in diameter than the drive piston 115, as a result of which no reaction force of moving the housing 111 upwardly is produced at all. A part of the reaction force which is produced in response to the upward movement of the weight piston 121 is canceled by the reaction force of the drive piston 115; however, a reaction force attributing to the difference in diameter between the drive piston and the weight piston is produced in a downward direction as much as the difference in diameter between the drive cylinder 114 and the sub-cylinder 120. The reaction force thus produced is transmitted through the drive cylinder 114 to the housing 111, thus moving the latter 111 downwardly.

As the weight piston 121 is moved upwardly, an upward force acts on the cylinder cap 119 and accordingly on the housing 111 through the compression spring 122 interposed between the weight piston 121 and the cylinder cap 119. This upward force applied through the compression spring 122 is made equal to the downward drive force attributing to the difference in diameter by adjusting the latter, so that the upward movement of the housing 111 due to the reaction is completely eliminated. On the other hand, if the downward reaction force attributing to the difference in diameter is increased by increasing that difference in diameter, then a downward force is positively applied to the housing 111.

When, after the nailing operation, the trigger lever 129 and the safety mechanism 128 are released; that is, the trigger valve 129 is placed in its initial state, compressed air is supplied into the control chamber 125' of the main valve 125, so that the latter 125 is returned to the lower position. There-upon, the drive cylinder 114 and the sub-cylinder 120 are communicated through the air discharge hole 126 with the outside air, so that the compressed air is discharged from those cylinders 114 and 120. The drive piston 115 is returned to the top dead center being pushed upwardly by the compressed air in a return chamber 114 which is formed around the drive cylinder 114, and it is locked there being engaged with the piston holder 123' of the piston stop 123. On the other hand, the weight piston 121 is returned to the bottom dead center by the elastic force of the compression spring 122, where it is held in contact with the upper end face of the piston stop 123.

Figure 9:
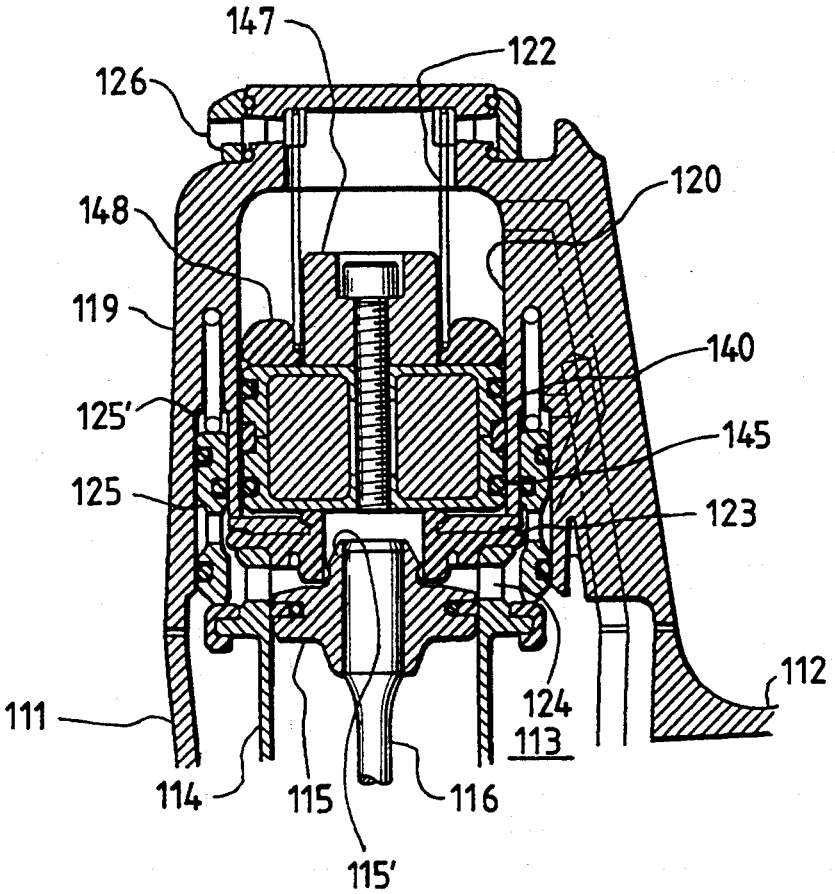
FIG. 9 is a vertical sectional side view showing a nailing machine to which furthermore example of the impulsion mechanism according to the invention is applied.

A nailing machine, to which furthermore example of the impulsion mechanism according to the invention is applied, will be described with reference to FIGS. 9 and 10.

Figure 10:
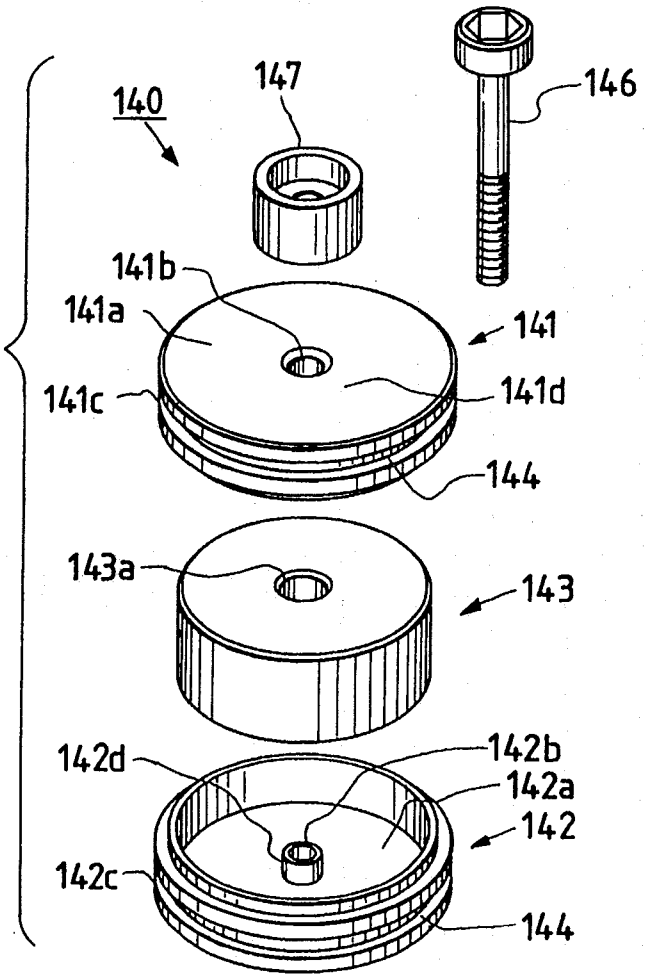
FIG. 10 is an exploded perspective view showing the structure of a weight piston in the impulsion mechanism shown in FIG. 9.

As shown in FIG. 10 in detail, its weight piston 140 comprises: upper and lower piston bodies 141 and 142 which are each made of a metal material such as iron or aluminum in the form of a cup; and a core member 143 made of a metal material high in specific gravity such as lead or tungsten which is fitted in the space which is defined by the upper and lower piston bodies 141 and 142. The upper piston body 141, forming the upper portion of the weight piston 140, is made up of a disk-shaped top 141*a* having an opening 141*b* at the center, a cylindrical wall 141*c* extended downwardly from the peripheral edge of the disk-shaped top 141*a*, and a cylindrical protrusion 141*d* extended downwardly from the peripheral edge of the opening 141*b*. Similarly, the lower piston body 142, forming the lower portion of the weight piston 140, is made up of a disk-shaped bottom 142*a* having an opening 142*b* at the center, a cylindrical wall extended upwardly from the peripheral edge of the disk-shaped bottom 142*a*, and a cylindrical protrusion 142*d* extended upwardly from the peripheral edge of the opening 142*b*. Annular grooves 144 are formed in the outer surfaces of the cylindrical walls 141*c* and 142*c* of the upper and lower piston bodies 141 and 142, respectively. O-rings 145 are fitted in the annular grooves 144, respectively, so that the weight piston is air-tightly and slidably fitted in the sub-cylinder 120.

The core member 143 is so shaped that it is fittable in the annular space which is defined by the cylindrical walls 141*c* and 142*c* and the cylindrical protrusions 141*d* and 142*d* of the upper and lower piston bodies 141 and 142; that is, it is in the form of a ring having a through-hole 143*a* at the center. The upper and lower piston bodies 141 and 141 are secured to each other with a bolt 146. More specifically, after the upper and lower piston bodies 141 and 142 and the core member 143 are assembled together by fitting the latter 143 in the annular space in the upper and lower piston bodies 141 and 142, the bolt 146 is inserted into the assembly from above; that is, the bolt 146 is inserted into the opening 141*b* of the upper piston body 141, the through-hole 143*a* of the core member 143, and the opening 142*b* of the lower piston body 142 in the stated order, to form the weight piston 140. With the O-rings 145 fitted in the annular grooves 144, the weight piston 140 is fitted in the sub-cylinder 120 formed in the cylinder cap 119. It should be noted that a cylindrical spring guide 147 for guiding the compression spring 122 is secured to the upper end face of the upper piston body 141 with the bolt 146. In addition, an elastic member 148 is placed on the upper end face of the weight piston 140, to absorb the shock and noise which are produced when the weight piston strikes against the inner surface of the upper wall of the cylinder cap 119.

While the present invention has been described above with respect to preferred embodiments thereof, it should of course be understood that the present invention should not be limited only to these embodiments but various changes or modifications may be made without departure from the scope of the invention as defined by the appended claims.

What is claimed is:

1. A compressed-air-operated impulsion mechanism comprising:

an impulsion cylinder member having a longitudinal axis;

an impulsion piston slidably fitted in said impulsion cylinder member along said longitudinal axis, said impulsion piston having an effective area facing a first direction; and a reaction force absorbing means for absorbing a reaction force of said impulsion piston arising when said impulsion piston is driven in a second direction opposite said first direction, said reaction force absorbing means being slidably fitted in said impulsion cylinder member along said longitudinal axis, said reaction force absorbing means having an effective area facing said second direction which is greater than said effective area of said impulsion piston, said respective effective areas being opposed to one another in said impulsion cylinder member such that compressed air is introduced therebetween to thereby drive said reaction force absorbing means in said first direction and drive said impulsion piston in said second direction.

2. A compressed-air-operated impulsion mechanism according to claim 1, wherein an air supply hold is formed in a wall of said cylinder member for leading compressed air between said impulsion piston and said reaction force absorbing means.

3. A compressed-air-operated impulsion mechanism according to claim 1, wherein said impulsion cylinder member comprises an impulsion cylinder in which said impulsion piston is slidably accommodated and a sub-cylinder in which said reaction force absorbing means is slidably accommodated, said sub-cylinder having a larger inner diameter than said impulsion cylinder.

4. A compressed-air-operated impulsion mechanism according to claim 1, wherein said reaction force absorbing means comprises a weight piston moved by said compressed air in said impulsion cylinder member.

5. A compressed-air-operated impulsion mechanism according to claim 4, wherein said reaction force absorbing means further comprises a spring mounted on said housing for biasing said weight piston in said second direction.

6. A compressed-air-operated impulsion mechanism according to claim 4, wherein at least a part of said weight piston is made of a metal material high in specific gravity.

* * * * *

UNITED STATES PATENT AND TRADEMARK OFFICE
CERTIFICATE OF CORRECTION

PATENT NO. : 5,437,339

DATED : August 1, 1995

INVENTOR(S) : TANAKA

It is certified that error appears in the above-identified patent and that said Letters Patent is hereby corrected as shown below:

On the title page, item [54] and in column 1, lines 1 and 2, the title should read as --AIR-PRESSURE-OPERATED IMPULSION MECHANISM--.

Signed and Sealed this

Seventeenth Day of October, 1995

*Attest:*

Bruce Lehman

BRUCE LEHMAN

*Attesting Officer*

*Commissioner of Patents and Trademarks*